US009708834B2

(12) United States Patent
Edell

(10) Patent No.: US 9,708,834 B2
(45) Date of Patent: Jul. 18, 2017

(54) COMBINATION BICYCLE LOCK AND PUMP

(71) Applicant: Joseph Edell, Arlington, VA (US)

(72) Inventor: Joseph Edell, Arlington, VA (US)

( * ) Notice: Subject to any disclaimer, the term of this patent is extended or adjusted under 35 U.S.C. 154(b) by 0 days.

(21) Appl. No.: 15/295,982

(22) Filed: Oct. 17, 2016

(65) Prior Publication Data

US 2017/0030113 A1 Feb. 2, 2017

Related U.S. Application Data

(63) Continuation of application No. 14/589,773, filed on Jan. 5, 2015, now Pat. No. 9,500,008.

(51) Int. Cl.

| | |
|---|---|
| ***E05B 71/00*** | (2006.01) |
| ***F04B 33/00*** | (2006.01) |
| ***F04B 39/12*** | (2006.01) |
| ***F04B 53/14*** | (2006.01) |
| ***E05B 67/00*** | (2006.01) |
| ***E05B 37/02*** | (2006.01) |

(52) U.S. Cl.

CPC ..... *E05B 71/00* (2013.01); *E05B 37/025* (2013.01); *E05B 67/003* (2013.01); *F04B 33/005* (2013.01); *F04B 39/12* (2013.01); *F04B 53/14* (2013.01)

(58) Field of Classification Search

CPC ..... F04B 33/005; F04B 39/12; F04B 53/14; Y10T 70/5872; Y10T 137/3584; E05B 71/00; E05B 67/063; E05B 45/005; E05B 67/003; E05B 67/10; E05B 73/0011; E05B 67/00; B62K 19/30; B62K 19/42

USPC ..... 70/30, 49, 233

See application file for complete search history.

(56) References Cited

U.S. PATENT DOCUMENTS

| | | | |
|---|---|---|---|
| 1,329,784 | A | 2/1920 | Lundin |
| 1,338,512 | A | 4/1920 | Lundin |
| 4,033,160 | A | 7/1977 | Mima |
| 4,615,191 | A | 10/1986 | Grandy |
| 4,842,290 | A | 6/1989 | Alioto |
| 5,216,902 | A | 6/1993 | Sagi |
| 5,255,546 | A | 10/1993 | Saunders et al. |
| 5,513,508 | A | 5/1996 | Saunders et al. |
| 5,715,554 | A | 2/1998 | Downs |

(Continued)

FOREIGN PATENT DOCUMENTS

| | | | |
|---|---|---|---|
| CN | 2658321 | Y | 11/2004 |
| DE | 3341819 | A1 | 4/1985 |

(Continued)

*Primary Examiner* — Suzanne Barrett

(57) ABSTRACT

A combination lock and pump for use with a bicycle. The combination lock and pump has a flexible cable including an inflation tube running parallel with a metal rope or chain. The flexible cable has a male end preferably including a lock bolt or shackle and a piston-cylinder pump. The flexible cable also has a female end preferably including a lock cylinder with a key hole and one or more apertures to receive either a bicycle tire's valve stem or the male end's lock bolt or shackle. When used as a lock, the combination secures the bicycle from theft by looping the flexible cable around the bicycle and locking together its male and female ends. When used as a pump, the combination's female end attaches to the bicycle tire's valve stem and inflates the tire by actuating the pump of the male end.

20 Claims, 16 Drawing Sheets

(56) References Cited

U.S. PATENT DOCUMENTS

| | | | | |
|---|---|---|---|---|
| 5,960,815 | A | 10/1999 | Wang | |
| 6,289,920 | B1 | 9/2001 | Wang | |
| 7,131,298 | B1 | 11/2006 | Haraughy | |
| 7,418,844 | B2 | 9/2008 | Reeves | |
| 7,862,065 | B2 | 1/2011 | Hawkins et al. | |
| 8,151,604 | B2 | 4/2012 | Thomas et al. | |
| 8,641,069 | B2 | 2/2014 | Haager | |
| 9,500,008 | B2 * | 11/2016 | Edell | E05B 71/00 |
| 2003/0156950 | A1 | 8/2003 | Ostrowiecki | |
| 2006/0140801 | A1 | 6/2006 | Hepfner | |
| 2006/0179902 | A1 | 8/2006 | Reeves | |
| 2006/0266085 | A1 | 11/2006 | Reeves | |
| 2010/0043508 | A1 | 2/2010 | Burmesch et al. | |
| 2011/0148067 | A1 | 6/2011 | Haager | |
| 2016/0194905 | A1 | 7/2016 | Edell | |

FOREIGN PATENT DOCUMENTS

| | | | |
|---|---|---|---|
| DE | 10040704 | A1 | 3/2001 |
| DE | 0142278 | A1 | 5/2002 |
| DE | 10131481 | A1 | 6/2002 |
| DE | 101162284 | A1 | 7/2003 |
| DE | 20220513 | U1 | 9/2003 |
| FR | 2529961 | A1 | 1/1984 |

* cited by examiner

COMBINATION BICYCLE LOCK AND PUMP

RELATED APPLICATION

The present application is a continuation of and claims priority to U.S. patent application Ser. No. 14/589,773, titled "Combination Bicycle Lock and Pump" and filed on Jan. 5, 2015, now U.S. Pat. No. 9,500,008, which is incorporated herein by reference in its entirety for all purposes.

BACKGROUND OF THE INVENTION

Bicycles are popular for recreation, exercise, and transportation. A bicycle user typically carries a number of accessories with her on the bicycle, which may include a bicycle lock, a tire inflation pump, replacement tubes, and tools for replacing tires and fixing components. Storing and transporting these accessories on a bicycle pose difficulties for the bicycle user as space on the bicycle is limited and these accessories add weight to the bicycle. These accessories may also be stolen when stored with the bicycle and left unattended.

A popular lock used to secure bicycles includes a flexible cable with first and second ends that lock together when in a locked position. The first and second ends of the flexible cable may lock together using a combination lock, a barrel lock, or a key operated lock arrangement.

A popular pump used to inflate bicycle tires is a handheld pump with a piston-cylinder combination. Another popular pump used to inflate bicycle tires is a floor pump that includes a piston-cylinder combination. These pumps include a nozzle aperture adapted to receive a Schrader tire valve stem, a Presta tire valve stem, or both.

Prior bicycle accessories have not provided a combination bicycle pump and lock incorporating a flexible cable for securing the bicycle when unattended. These accessories also did not provide a simple and reliable way of using one end to receive both to a tire valve stem for inflation and the male end of a flexible cable lock. These accessories further lack a flexible cable lock having one end with both a piston-cylinder pump and a lock bolt or shackle.

SUMMARY OF THE INVENTION

The present invention overcomes the deficiencies of the prior art by providing a combination lock and pump which incorporates a flexible, break-resistant cable with a male end that includes both a pump piston-cylinder and a lock bolt or shackle as well as a female end that includes a lock body and receiving aperture or apertures for a tire valve stem and the lock bolt or shackle. A pump air inflation tube connects the male end's piston-cylinder to the female end's receiving aperture. The inflation tube preferably runs parallel with the flexible cable.

In one configuration, the apparatus includes a first aperture in the female end capable of receiving the lock bolt when used as a lock and a second aperture in the female end capable of receiving the tire valve stem when used as a pump. The apparatus's second end also includes a lever arm used to releasably engage the tire valve stem when the stem is inserted into the second aperture. The pump piston-cylinder of the male end of the apparatus includes a handle connected to a piston that travels in a reciprocating fashion within a cylinder to force air into a bicycle tire tube.

In another configuration, the apparatus includes an aperture in the female end capable of receiving both the lock bolt when used as a lock and the tire valve stem when used as a pump. The apparatus's female end includes a lever used to releasably engage the tire valve stem when the stem is inserted into the aperture. The pump piston-cylinder of the male end of the apparatus includes a handle connected to a piston that travels in a reciprocating fashion within a cylinder to force air into a bicycle tire tube.

In another configuration, the apparatus includes a barrel lock and shackle configuration in which the female end is capable of receiving a tire valve as well as a shackle when in a locked position.

In other configurations, the female end includes apertures to accommodate Schrader and Presta valve stems and/or rectangular-shaped locking members of the male end.

In another configuration of the male end, the locking bolt is capable of being secured in the female end when in a locked position and forms part of a piston rod of the piston cylinder pump when in a pump configuration.

In other configurations, the pump of the present invention located away from the male and female ends or is a floor pump.

DETAILED DESCRIPTION OF THE PREFERRED EMBODIMENT

Figure 1:
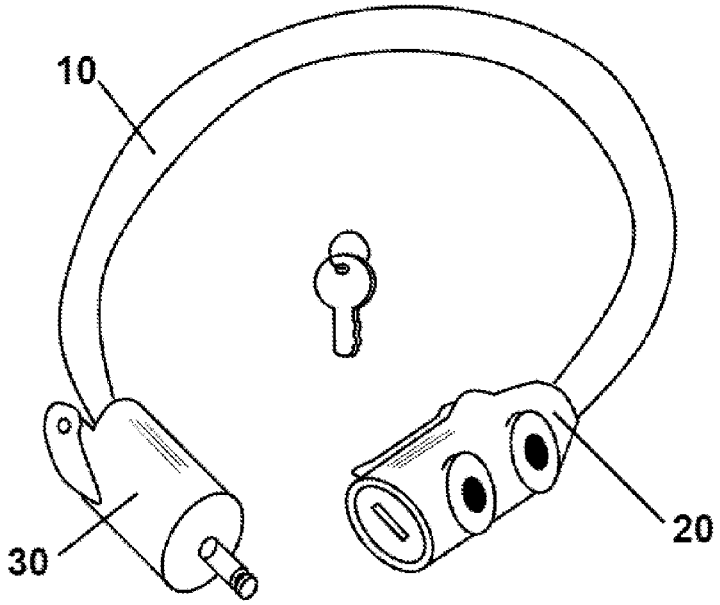
FIG. 1 is a perspective view of a first preferred embodiment of the present invention in an unlocked configuration.
Figure 2A:
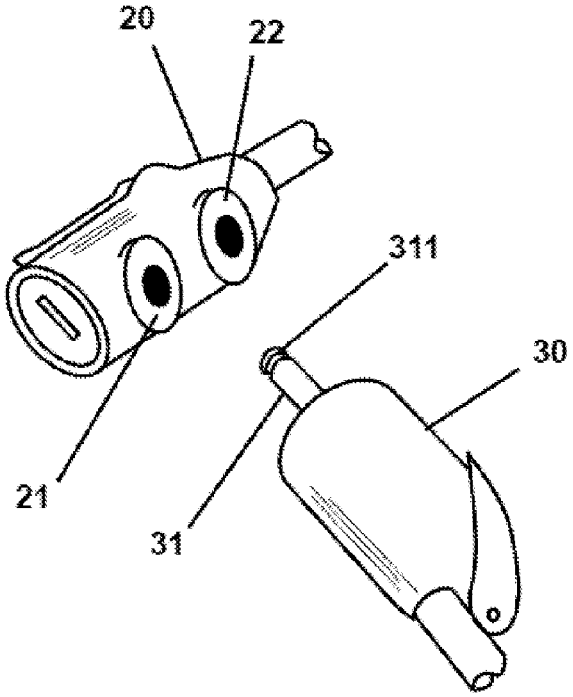
FIG. 2A is a perspective view of the Male and female ends of the first preferred embodiment in an unlocked configuration.
Figure 2B:
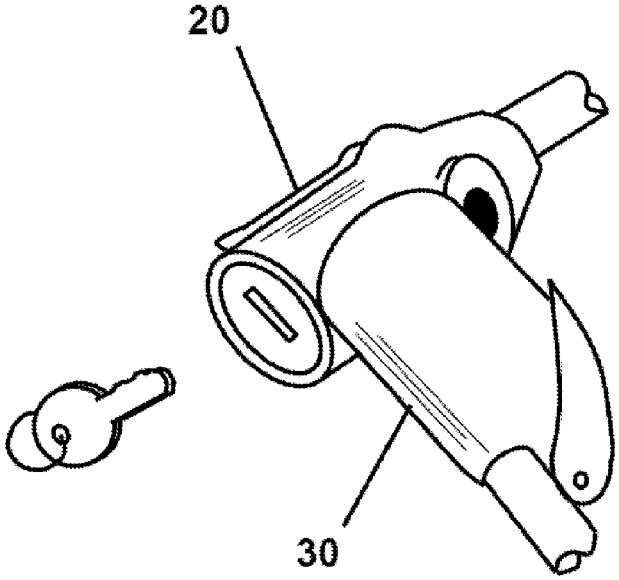
FIG. 2B is a perspective view of the male and female ends of the first preferred embodiment in a locked configuration.

The present invention is a combination lock and pump that has a flexible cable with first and second ends in which the first end is capable of both engaging the second end when in a locked position and engaging a valve of a bicycle tire for inflation. FIG. 1 is a perspective view of the first embodiment of the combination lock and pump that includes a flexible cable 10 with a first end 20 and a second end 30. As shown in FIGS. 2A and 2B, the Second end 30 of the flexible cable 10 is a male end that includes a lock bolt 31 capable of being secured in a lock aperture 21 of the first end 20 of the flexible cable 10 when in a locked position. The lock bolt 31 of the second end 30 includes a circumferential groove 311 capable of being secured within the lock aperture 21 of the first end 20 when in the locked position. The first end 20 is a female end that includes the lock aperture 21, a pump aperture 22 capable of receiving a tire valve stem of a tire, a lock cylinder 23 with a key hole 231, and a lever arm 27 for releasably securing the first end 20 to the tire valve stem.

Figure 3A:
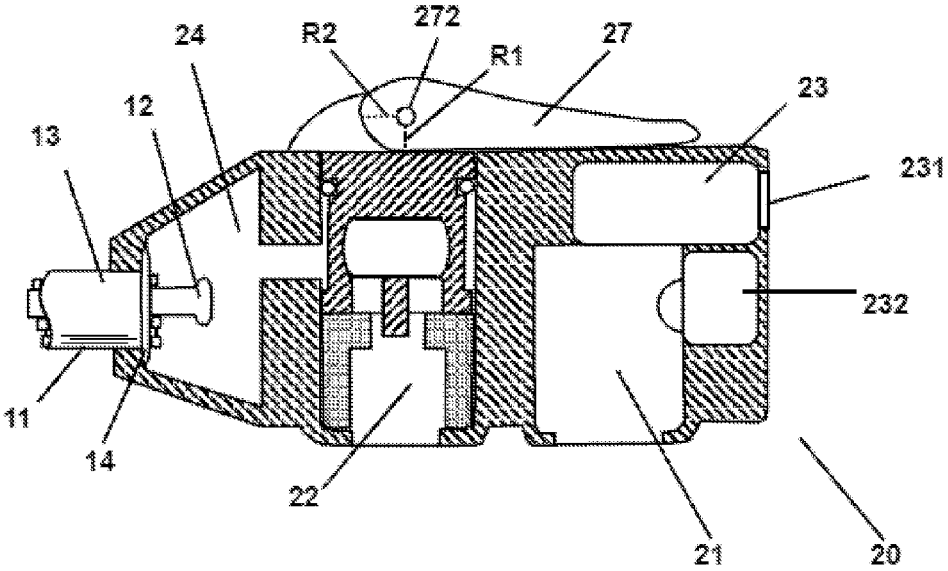
FIG. 3A is a cross-sectional view of the female end of the first preferred embodiment in an unlocked configuration and in a non-inflation configuration.
Figure 3B:
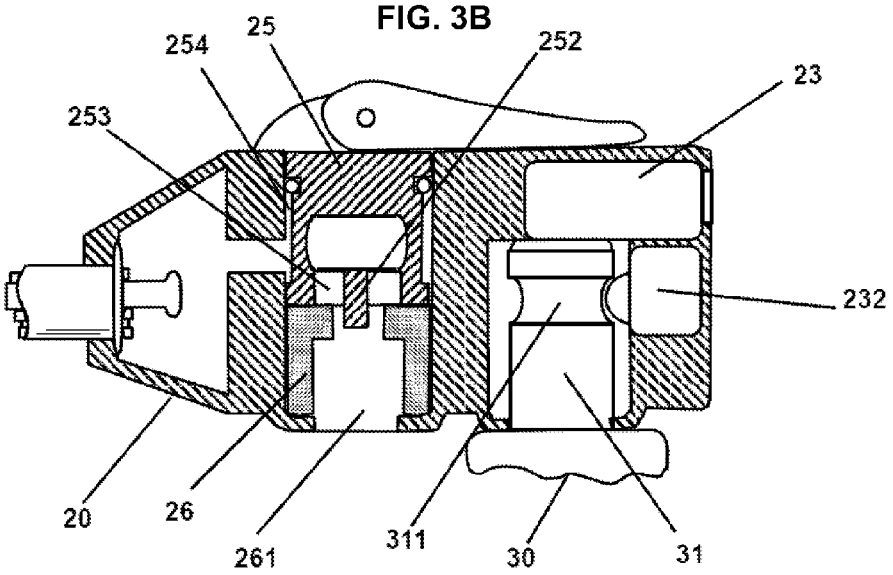
FIG. 3B is a cross-sectional view of the female end of the first preferred embodiment in a locked configuration.
Figure 3C:
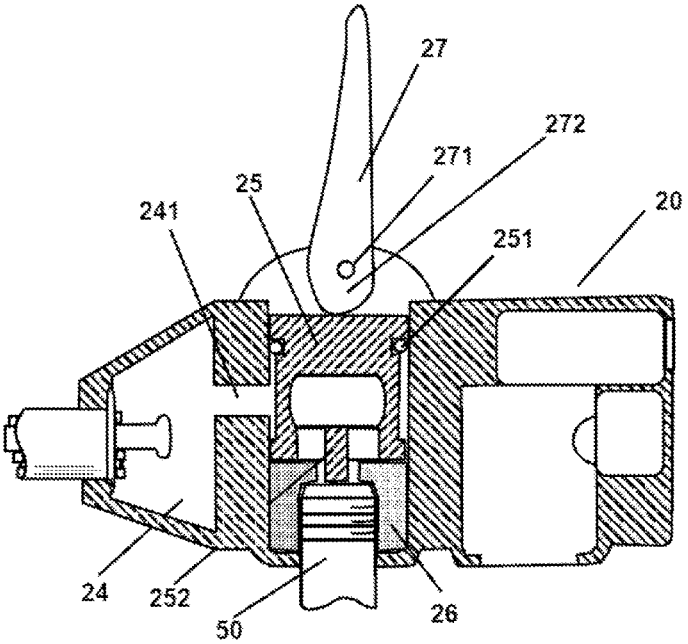
FIG. 3C is a cross-sectional view of the female end of the first preferred embodiment in an inflation configuration.

The internal components of the first end 20 of the first embodiment are shown in FIGS. 3A, 3B, and 3C. The first end 20 includes an aperture to receive the lock cylinder 23. The lock cylinder 23 engages a lock lug 232 to releasably secure the groove 311 of the lock bolt 31 when in the locked position, as shown in FIG. 3B. As is known in the art, rotation of a key in the lock cylinder 231 results in the locking and unlocking engagement of the lock lug 232. For example and without limitation, this application incorporates by reference the cable lock disclosed in U.S. Pat. No. 4,075,878.

Figure 3D:
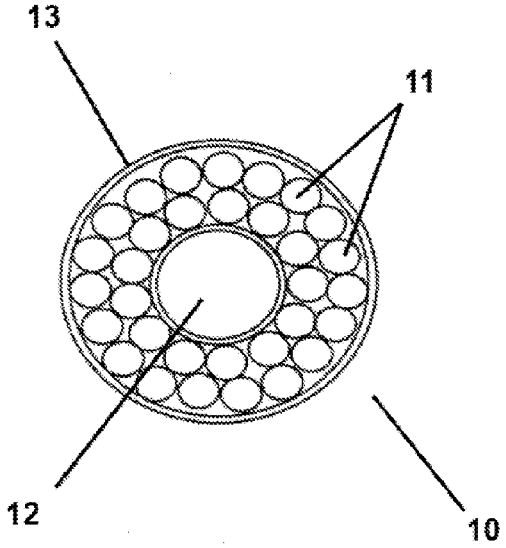
FIG. 3D is a cross-sectional view of the flexible cable of the first preferred embodiment.

As shown in FIG. 3A, the flexible cable 10 includes steel rope 11 made of multiple strands of galvanized steel laid together and an inflation tube 12 that runs parallel to steel rope 11. The flexible cable 10 further includes a coating 13 made of plastic or cloth to protect the steel rope 11 and inflation tube 12 from corrosion and damage. The coating 13 is swaged to the flexible cable 10. The steel rope may also be a metal chain that runs parallel to the inflation tube 12. FIG. 3D shows a cross-section of the flexible cable 10 in which the strands of the steel rope 11 run parallel to the inflation tube 12 and are encased by coating 13. While the rope 11 is described as made of steel, the rope 11 may be made of any break-resistant material, such as high density plastic.

The first end 20 of the first embodiment includes a cavity 24 for receiving a collar 14 of the flexible cable 10 that prevents flexible cable 10 from being withdrawn from the first end 20. The inflation tube 12 of the flexible cable 10 extends from the first end 20 to the second end 30, as described in further detail below. The cavity 24 of the first end 20 houses one end of the inflation tube 12. The first end 20 includes an air passage 241 that connects the cavity 24 to the pump aperture 22 to allow air to pass from the inflation tube 12 to the pump aperture 22. The pump aperture 22 houses an urging member 25 with a leakproof ring 251 and an elastic body 26.

When in a non-inflation position as shown in FIG. 3A, the lever arm 27 extends parallel to the body of the first end 20. The lever arm 27 is rotatably attached to the first end 20 by a pin 271. The lever arm 27 includes a head 272 with a first surface located a first distance R1 from the pin 271 and a second surface located a second distance R2 from the pin 271. The second distance R2 being a greater distance away from the pin 271 than the first distance R1.

The urging member 25 of the first end 20 includes a protrusion 252 partly surrounded by a duct 253. The urging member 25 also includes a through hole 254 to allow air to pass from the air passage 241 to the duct 253. The urging member contacts the head 272 of the lever arm 27 on one end and the elastic body 26 at another end. The elastic body 26 includes a duct 261.

When in an inflation position as shown in FIG. 3C, the lever arm 27 extends upwardly from the first end 20 and the head 272 of the lever arm 27 pushes the urging member 25 downwardly because the second distance R2 of the head is greater than the first distance R1. In turn, the urging member 25 pushes the elastic body 26 such that the elastic body 26 deforms to securely engage a tire valve stem 50 that has been placed in the duct 261. The protrusion 252 of the urging member 25 releasably presses a pin of the tire valve stem 50 inwardly when the urging member 25 is pushes downwardly by the lever arm 27. When pressurized air is pumped through the inflation tube 12, as described below, the pressurized air passes from the cavity 24 of the first end 20 to the duct 253 via the air passage 241 and through hole 254 and into the tire valve stem 50 to inflate the bicycle tire tube.

Figure 4A:
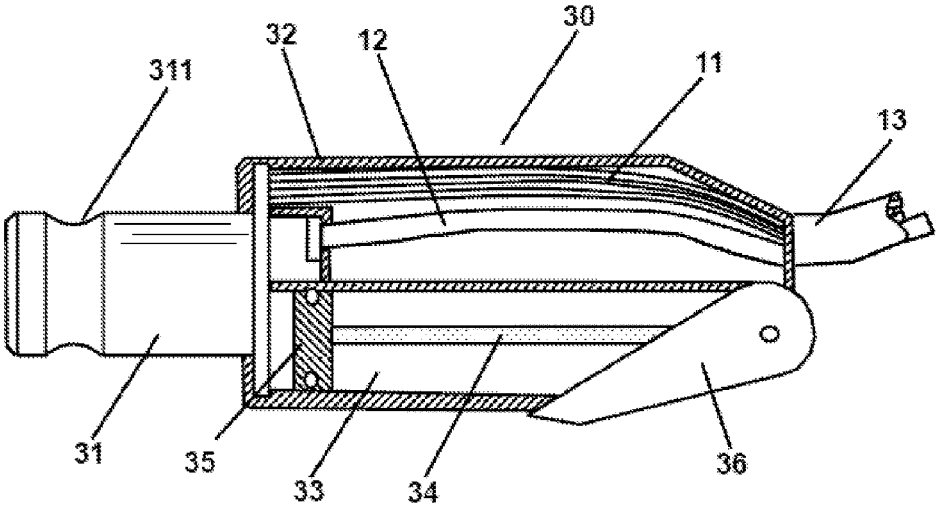
FIG. 4A is a cross-sectional view of the male end of the first preferred embodiment with a piston handle in a storage configuration.
Figure 4B:
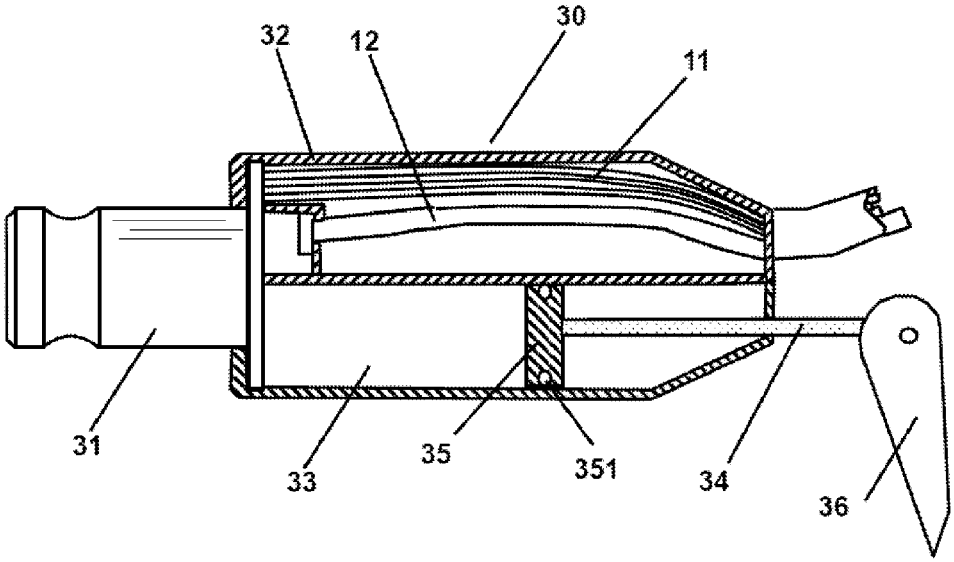
FIG. 4B is a cross-sectional view of the male end of the first preferred embodiment with the piston handle in a pump configuration.

FIGS. 4A and 4B show the second end 30 of the flexible cable 10 of the first embodiment of the present invention. The lock bolt 31 is securely attached to the steel rope 11 of the flexible cable 10. The second end 30 includes a housing 32 having a cylinder 33 with one end in communication with an end of the inflation tube 12. The pump of the combination lock and pump includes a piston rod 34 extending within the cylinder 33, a piston 35 connected to one end of the piston rod 34, and a seal 351 disposed around the outer periphery of the piston 35. The seal 351 deforms on an upstroke permitting air to enter the cylinder 33 around the deformed seal 351. The seal 351 seals the piston 35 within the cylinder 33 on a downstroke to create a pressurized air chamber. During the downstroke of the piston 35, pressurized air travels from one end of the inflation tube 12 in the second end 30 to the pump aperture 22 in the first end 20 to inflate a bicycle tire tube when the first end is in the inflation position.

The piston rod 34 includes another end rotatably connected to a handle 36. The handle 36 is capable of rotating between a folded storage position, as shown in FIG. 4A, and an unfolded pump position, as shown in FIG. 4B.

Figure 5:
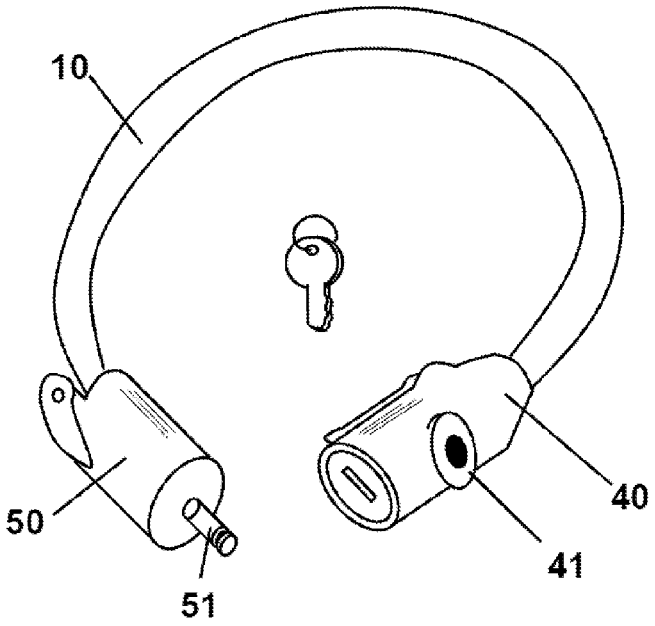
FIG. 5 is a perspective view of the male and female ends of a second preferred embodiment of the present invention in an unlocked configuration.

As shown in FIG. 5, the second embodiment of the present invention is similar in construction to the first embodiment described above with the principal difference being the first end 40 has a dual-use aperture 41 to receive both a lock bolt 51 in a locked position and a tire valve stem of a tire (not shown) in an inflation position. The second end 50 of the second embodiment includes the lock bolt 51 with a circumferential groove 511.

Figure 6A:
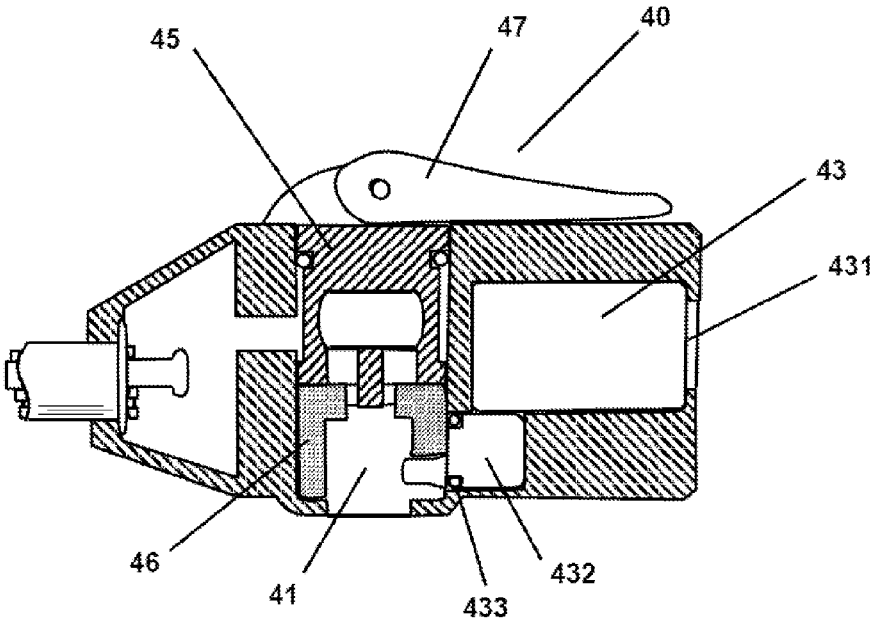
FIG. 6A is a cross-sectional view of the female end of the second preferred embodiment in an unlocked configuration and in a non-inflation configuration.
Figure 6B:
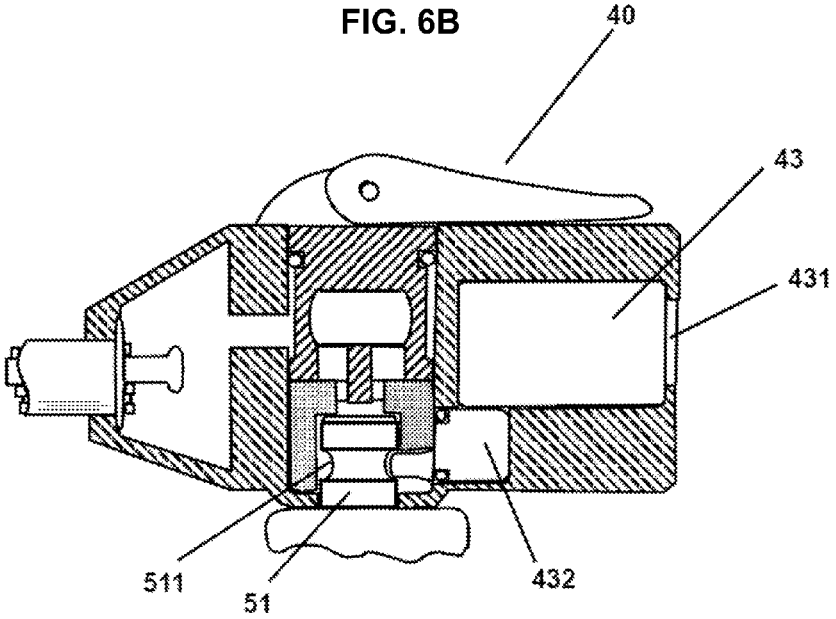
FIG. 6B is a cross-sectional view of the female end of the second preferred embodiment in a locked configuration.
Figure 6C:
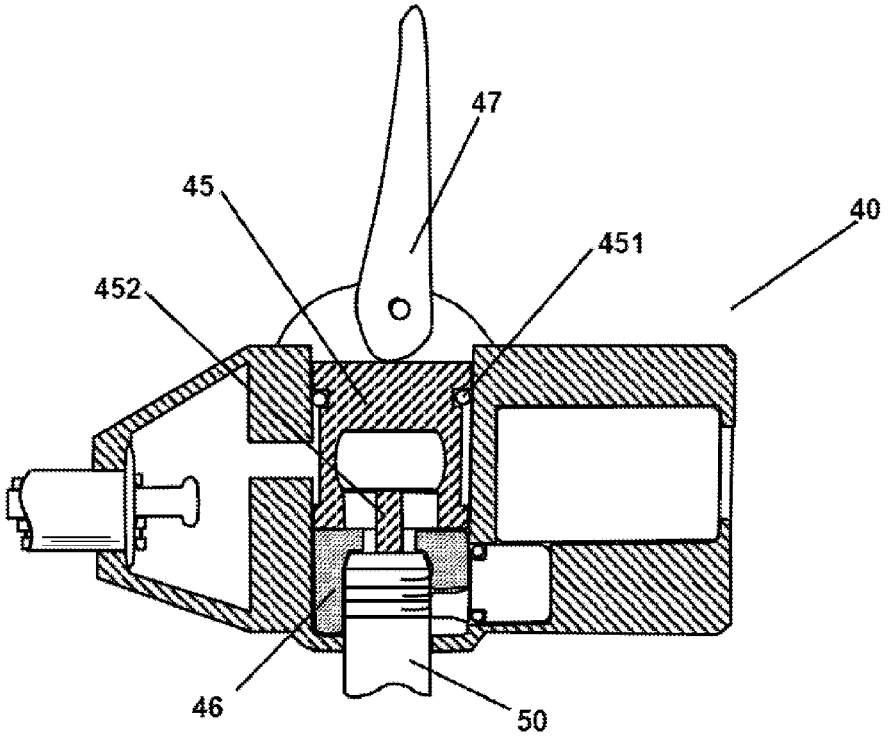
FIG. 6C is a cross-sectional view of the female end of the second preferred embodiment in an inflation configuration.

The internal components of the first end 40 of the second embodiment are shown in FIGS. 6A, 6B, and 6C. The first end 40 includes an aperture to receive the lock cylinder with a key hole 431. The lock cylinder 43 engages a lock lug 432 to releasably secure the groove 511 of the lock bolt 51 when in the locked position, as shown in FIG. 6B. As is known in the art, rotation of a key in the lock cylinder 43 results in the locking and unlocking engagement of the lock lug 432. The lock lug 432 is positioned adjacent to the opening of the dual-use aperture 41 and includes a leakproof ring 433 to prevent the leakage of air when using the second embodiment as a pump.

Like in the first embodiment of the present invention, the second embodiment includes an urging member 45 with a leakproof ring 451 and an elastic body 46. The urging member 45 and the elastic body 46 are housed in the dual-use aperture 41. In the second embodiment, a portion of the elastic body 46 is removed to allow for the passage of the lock lug 432 into the groove 511 of the lock bolt 51 when in the locked position, as shown in FIG. 6B.

A lever arm 47 pushes the urging member 45 downwardly when the lever arm 47 extends upwardly in an inflation position, as shown in FIG. 6C. The urging member 45 then pushes the elastic body 46 such that the elastic body 46 deforms to securely engage the tire valve stem 50. Protrusion 452 of the urging member 45 releasably presses the pin of the tire valve stem 50 inwardly when in the inflation position to allow pressurized air pumped through the inflation tube 12 to pass through the dual-use aperture 41 into the tire valve stem 50 to inflate the bicycle tire tube. The locking lug 432 does not impede the tire valve stem when in the unlocked position.

Figure 7A:
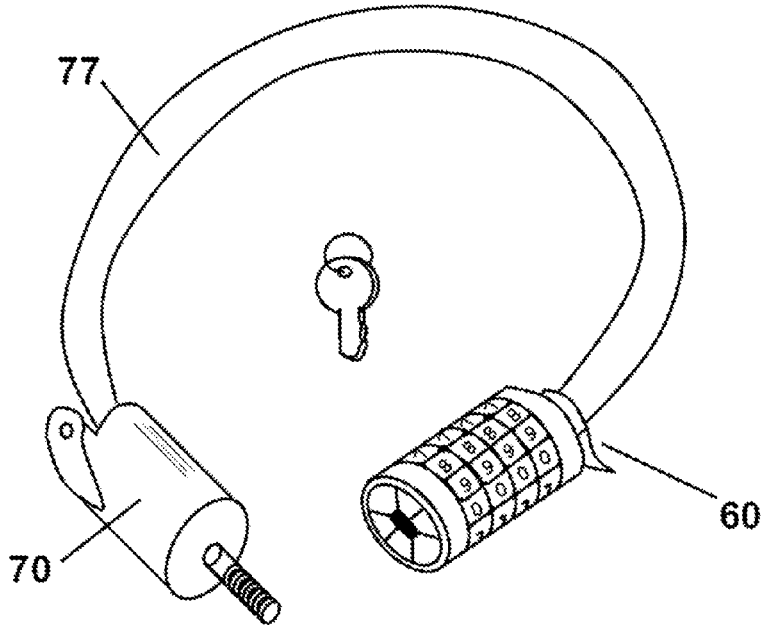
FIG. 7A is a perspective view of a third preferred embodiment of the present invention in an unlocked configuration.
Figure 7B:
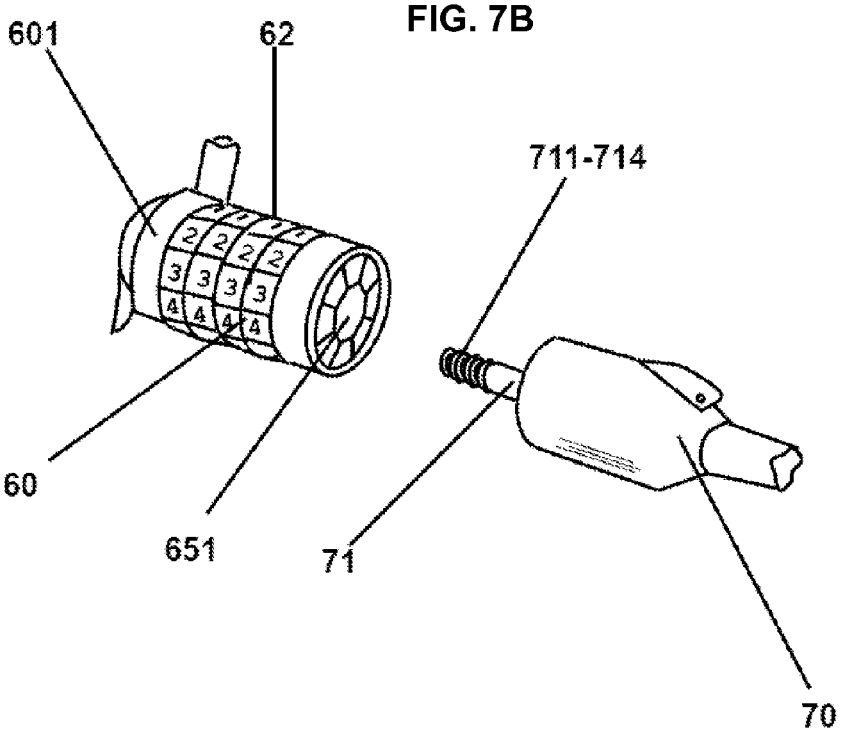
FIG. 7B is a perspective view of the male and female ends of a third preferred embodiment of the present invention in an unlocked configuration.

As shown in FIGS. 7A and 7B, the third embodiment of the present invention is similar in construction to the first and second embodiments described above with the principal difference being the first end 60 has a barrel lock configuration. The barrel lock configuration of the first end 60 has an end cap 601 and combination wheels 62. The first end 60 receives an end of inflation tube 608 of flexible cable 77. The second end 70 of the third embodiment includes a shackle 71 with circumferential grooves 711, 712, 713, and 714.

The internal components of the first end 60 of the third embodiment are shown in FIGS. 8A, 8B, 8C, and 8D. The first end 60 includes an aperture 651 to receive the shackle 71. A distal end of the end cap 601 includes both a groove for housing a lever arm 63 and apertures 603 for receiving a pivot pin 604. The first end 60 further includes a shaft body 65, a collet 66, and clutches 621-624. The shaft body 65 includes a collar 652 at one end of the aperture 651 for receiving the shackle 31. The collar 652 includes a collet bore 653 for receiving a head 661 of the collet 66.

As further shown in FIGS. 8A-8D, the collet 66 includes arms 662 extending in parallel from the head 661 and pin bores 664 on an end opposite the head 661 integrally formed with head 661 of the collet 66 is a plurality of fingers 663. When the collet 66 is inserted within the collet bore 653, the arms 662 extend through passages 659 in a distal portion of the collet bore 653 such that the head 661 is housed within the collet bore 653. When the collet 66 is inserted within the collet bore 653, the arms 662 also extend through the passages 659 in the end cap 601 such that the pivot pin 604 may project through the collet pin bores 664 and apertures 603 in the end cap 601. The collet 66 further includes a dimple 665 on each arm 663.

As further shown in FIGS. 8A-8D, the shaft body 65 includes four aligned cylindrical well holes 654, 655, 656, 657 for receiving four locking balls 674, 675, 676, 677. Each of the clutches 621-624 has a locking ball recess 671 into which one of the locking balls 674-677 moves when the respective clutch is in the unlocked position and shackle 71 is pulled for removal. Each of clutches 621-624 also has projections 672 which can engage recesses 621 on each wheel 62. The shaft body 65 further includes a pair of aligned cylindrical well holes 658 for receiving securing balls 678.

A cylindrical elastic body 68 having a valve insertion opening is disposed within the collet 66 such that the collet fingers 663 contact the elastic body 68. The elastic body 68 is held in a central position within the collet bore 653 by a retaining ring 69 having a seating groove 691.

Figure 8A:
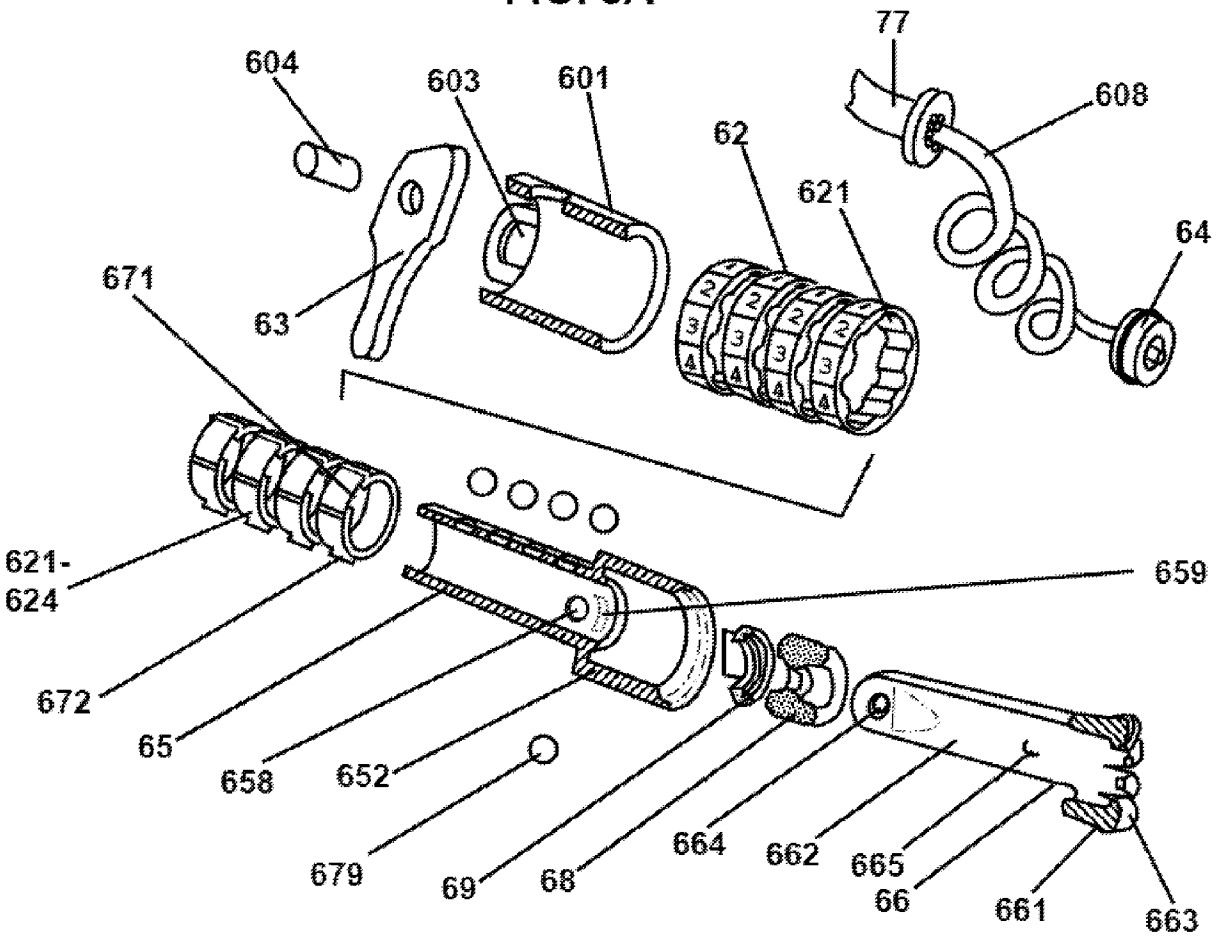
FIG. 8A is an exploded perspective view of the female end of the third preferred embodiment.
Figure 8B:
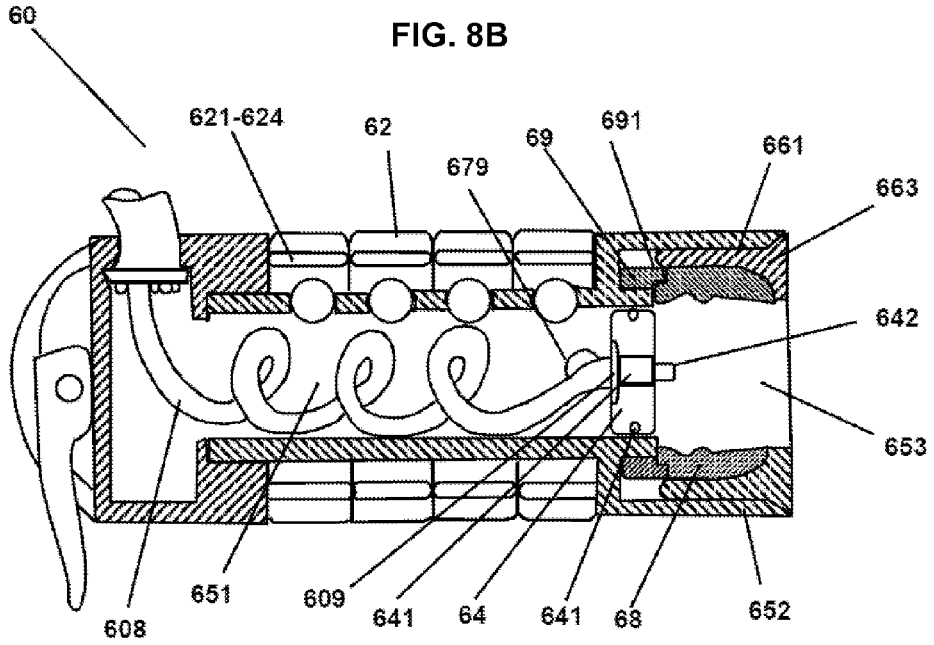
FIG. 8B is a cross-sectional view of the female end of the third preferred embodiment in an unlocked configuration and in a non-inflation configuration.

The first end 60 further includes an urging member 64 having a leakproof ring 641 and a protrusion 642 partly surrounded by a duct 643. One end of the duct 643 receives a collar 609 of the inflation tube 608. The end of the inflation tube 608 includes a cylindrical-shaped spring portion that urges the urging member 64 outwardly along the aperture 651 from a retracted position, as shown in FIG. 8C, to an extended position, as shown in FIG. 8B for use during inflation.

Figure 8C:
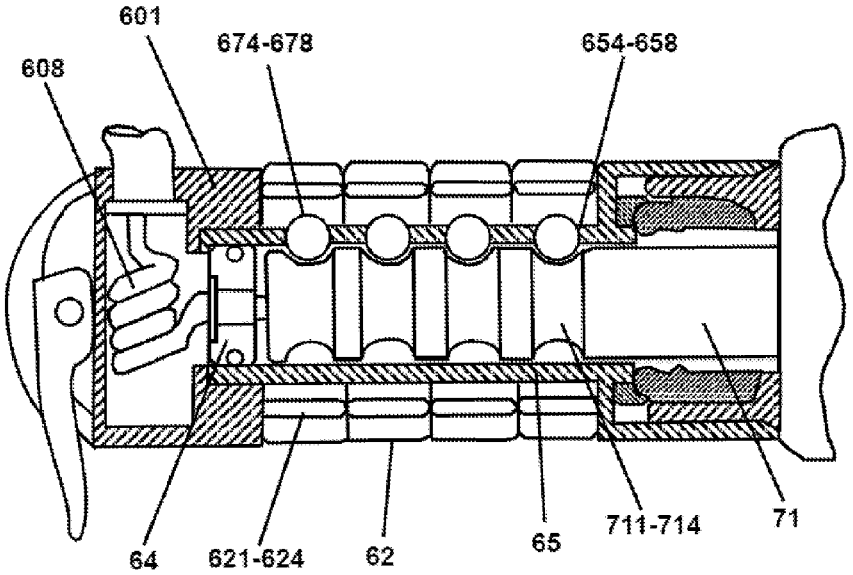
FIG. 8C is a cross-sectional view of the male and female ends of the third preferred embodiment in a locked configuration.

To place the third embodiment in the locked position as shown in FIG. 8C, the wheels 62 are rotated to an unlocked combination, the shackle 71 is inserted into the collar 652, collet bore 653, and into the aperture 651 of the shaft 65. As shackle 71 enters the aperture 651, the shackle 71 pushes the urging member 64 inwardly to its retracted position and balls 674-678 are cammed outwardly through well holes 654-658. In turn, the balls 674-677 enter the clutch recesses 671. Once the shackle 71 fully enters aperture 651, the balls 674-677 descend into the shackle grooves 711-714. One or more of the wheels 62 are then rotated to a locked position to retain at least one of the balls 674-677 in the shackle grooves 711-714. To unlock the third embodiment, each wheel 62 is rotated to its respective unlocked combination, the shackle 71 is then removed from the aperture 651 of the shaft 65. The protrusion or shackle 71, or both, may be made of a magnetized material to aid in moving the urging member 64 from the retracted position to the extended position during removal of the shackle 71 from the first end 60.

Figure 8D:
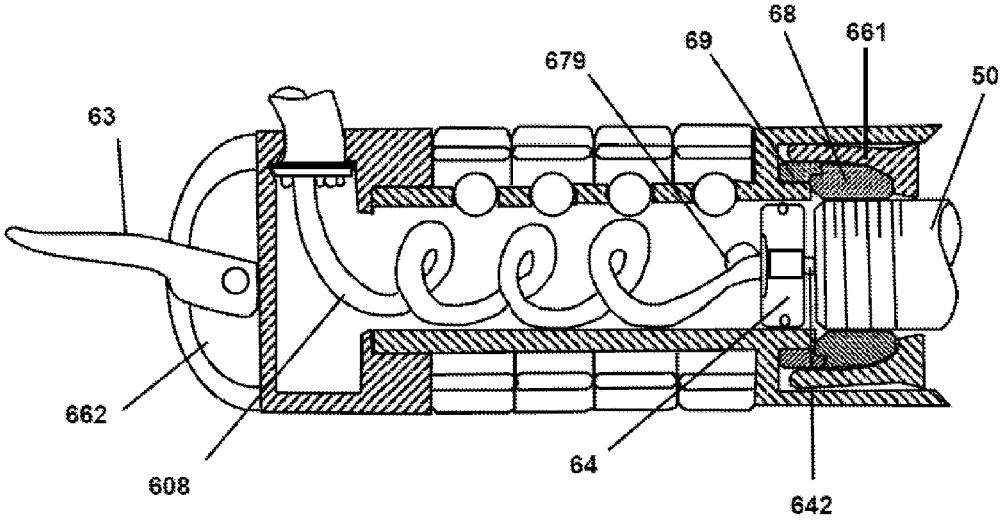
FIG. 8D is a cross-sectional view of the male and female ends of the third preferred embodiment in an inflation configuration.

When in an inflation position as shown in FIG. 8D, the lever arm 63 extends upwardly from the first end 60 and the head 631 pulls the pivot pin 604 upwardly thus pulling the collet 66 inwardly into the collet bore 653. The outwardly projecting portions of the collet fingers 663 are deflected inwardly by the sliding interaction of the collet head 661 against the outer edge of the housing sidewalls of the collar 652. The inward movement of the collet finger 663 causes the elastic body 68 to be squeezed inwardly to securely engage the tire valve stem 50. Because the urging member 64 had previously been urged outwardly by the springing action of the inflation tube 608 toward the collet bore 653, the urging member 64 extends passed the pair of well holes 658 and securing balls 679 of the shaft body 65. Each dimple 665 of the collet 66 urges the respective securing ball 679 into a securing position when the pivot pin 604 pulls the collet 66 upwardly, thus securing the urging member 64 in the extended position adjacent the collet bore 653.

FIGS. 9A-11B show an alternative embodiment of the second end 90 of the flexible cable 10 in which a locking bolt 91 forms part of the piston rod of the piston-cylinder pump. As shown in FIGS. 10A and 10B, the second end 90 includes a cap 92 with rotatably connected handle members 921, 922 and a securing portion 93 with recesses 931, 932 to accommodate a pair of projections 911, 912 on the locking, bolt 91. The second end 90 further includes a cylinder 94 with one end in communication with an end of the inflation tube 12. The cylinder 94 houses a piston 95 connected to one end of the locking bolt 91 and a seal 951 disposed around the outer periphery of the piston 95. The seal 951 deforms on an upstroke permitting air to enter the cylinder 94 around the deformed seal 951. The seal 951 seals the piston 95 within the cylinder 94 on a downstroke to create a pressurized air chamber. During the downstroke of the piston 95, pressurized air travels from one end of the inflation tube 12 in the second end 90 to the first end of the present invention to inflate a bicycle tire tube when the first end is in the inflation position.

Figure 9A:
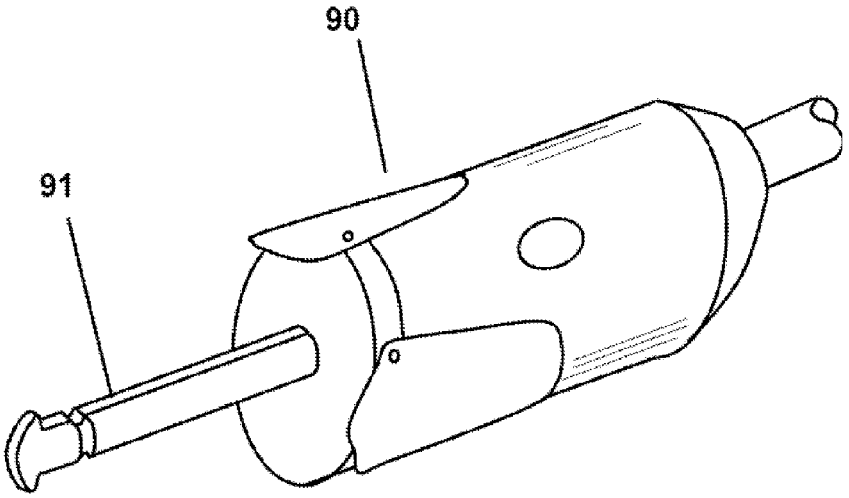
FIG. 9A is a perspective view of the male end of an alternative embodiment of the present invention and illustrating its use as a lock for the combination lock and pump.
Figure 9B:
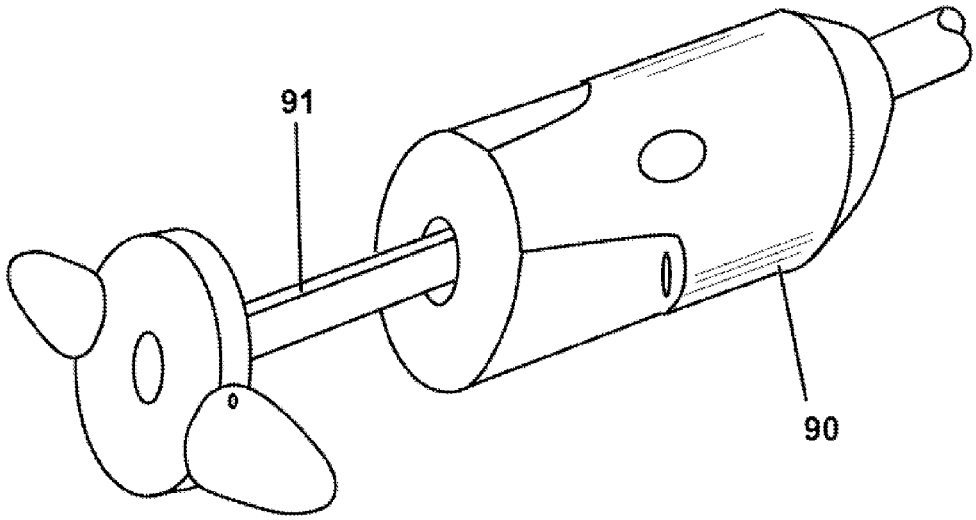
FIG. 9B is a perspective view of the male end of the alternative embodiment and illustrating its use as a pump for the combination lock and pump.
Figure 10A:
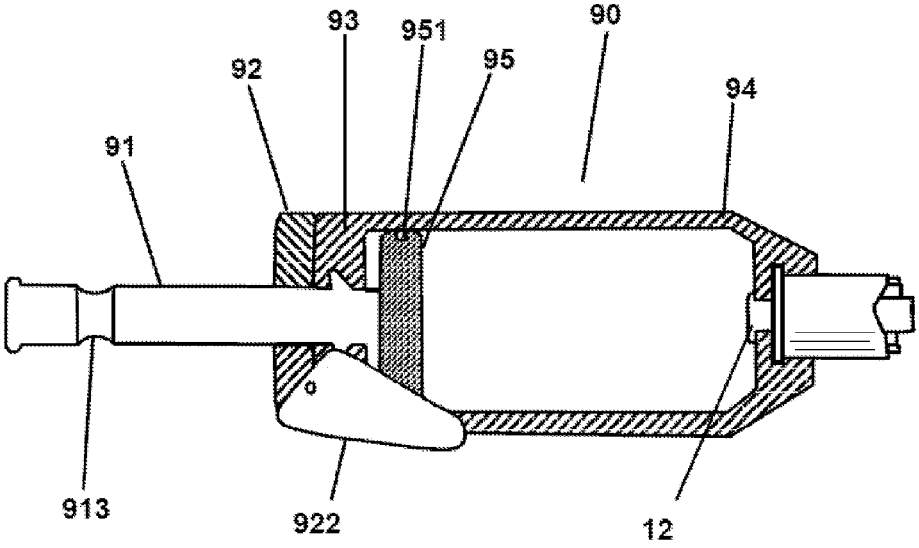
FIG. 10A is a cross-sectional view of the male end of the alternative embodiment and illustrating its use as a lock for the combination lock and pump.

When using the alternative embodiment as a lock as shown in FIGS. 9A and 10A, the cap 92 is releasably secured to the housing of the second end 90 by projections 923, 924 on the end of the handle members 921, 922. The projections 923, 924 are releasably held by latches 961, 962 in the housing of the second end 90. The second end 90 further includes a push button 96 to move latches 961, 962 to release the projections 923, 924 of the handle members 921, 922. When in use as a lock, the locking bolt 91 is secured in place by projections 911, 912 being retained in recesses 931, 932 of the securing portion 93. The locking bolt 91 further includes a circumferential groove 913 to lock the locking bolt 91 in place when inserted into the first end of the present invention. While the second member 90 is shown in FIGS. 9A-11B as having a locking bolt 91, the second member 90 may include a shackle with shackle grooves for use in a barrel lock configuration, as described in the third embodiment.

Figure 10B:
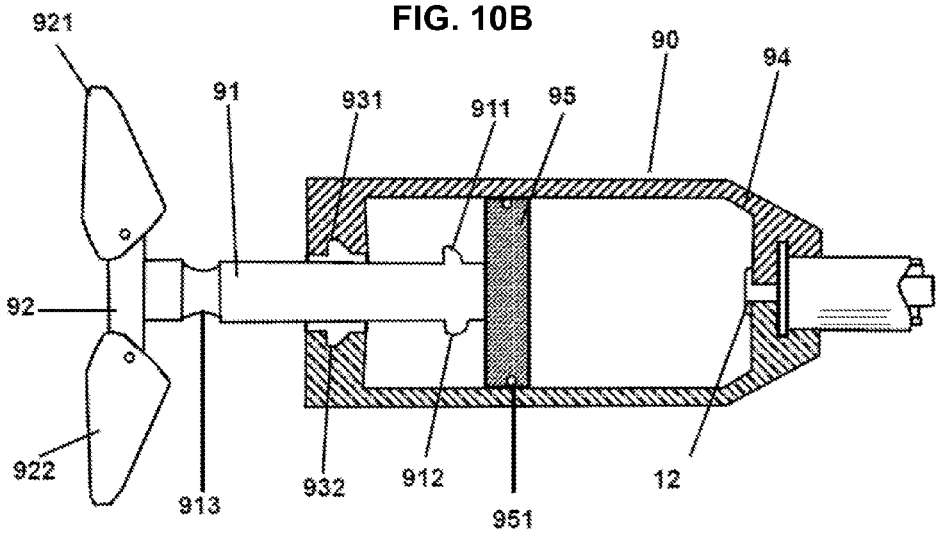
FIG. 10B is a cross-sectional view of the male end of the alternative embodiment and illustrating its use as a pump for the combination lock and pump.
Figure 11A:
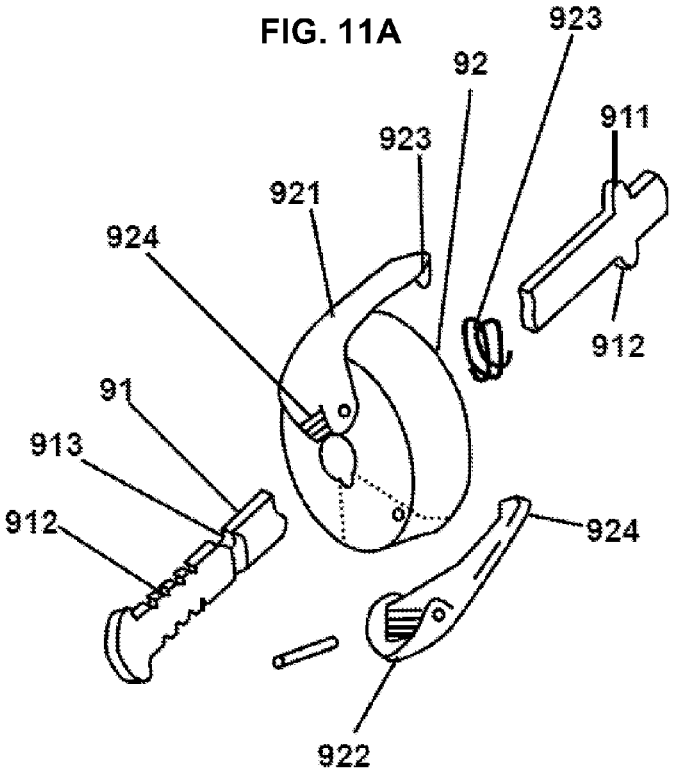
FIG. 11A is an exploded view of the male end's first cut-away section of the alternative embodiment.
Figure 11B:
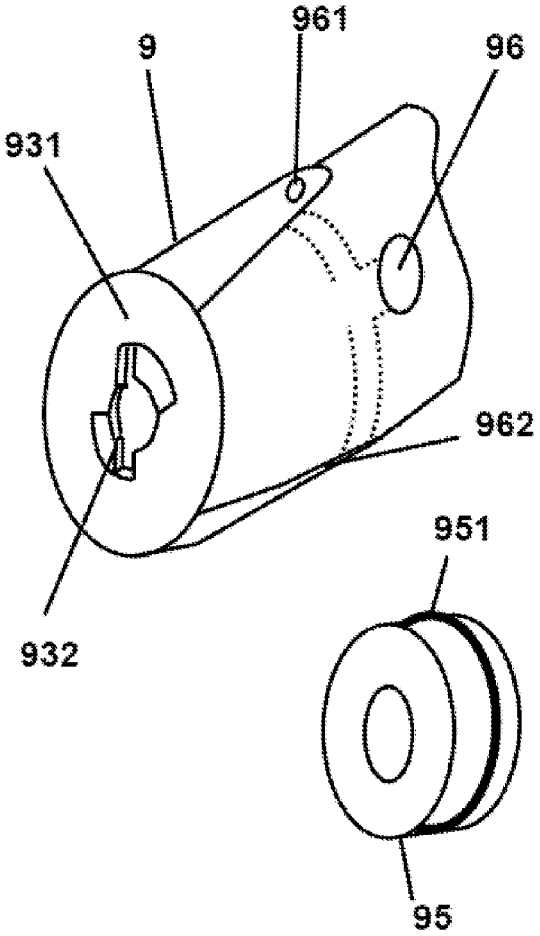
FIG. 11B is an exploded view of the male end's second cut-away section of the alternative embodiment.

Upon depressing push button 96, the handle members 921, 922 of the cap 92 are released so that the cap 92 may slide to the end of the locking bolt 91 to use the second end 90 as a pump, as shown in FIGS. 9B and 10B. FIG. 11A shows a cut-away section of the locking bolt 91 and cap 92, in which the cap 92 may include a spring 923 to urge the cap 92 upward toward the end of the locking bolt 91. The cap 92 may also include teeth 924 along the inner portion of each handle member 921, 922. The teeth 924 may engage teeth 912 on the locking bolt 91 to form a rack and pinion configuration such that each handle member 921, 922 rotates outwardly away from the cap 92 as the cap 92 slides toward the end of the locking bolt 91. When the cap 92 reaches the end of the locking bolt 91 and the handle members 921, 922 are fully rotated outwardly, the cap 92 may be rotated to rotate the locking bolt 91 to slide projections 911, 912 along recesses 931, 932 of the securing portion 93. FIG. 11B shows a cut-away section of the locking bolt 91, the securing portion 93, and the piston 95. Once completely rotated, the projections 911, 912 of the locking bolt 91 clear the recesses 931, 932 of the securing portion 93 such that the locking bolt 91 is no longer secured in place by the securing portion 93. As a result, the locking bolt 91 may act as a piston rod to slide piston 95 along cylinder 94 to use the the second end 90 as a pump.

Figure 12:
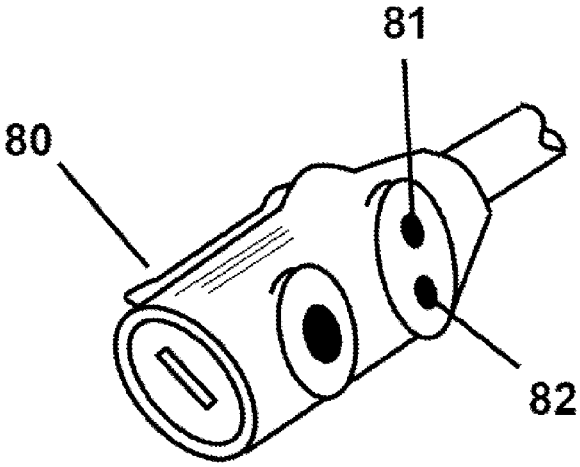
FIG. 12 is a perspective view of the female end of a fourth embodiment of the present invention in an unlocked configuration.

As shown in FIG. 12, the fourth embodiment of the present invention is similar in construction to the previous embodiments described above with the principal difference being the first end 80 has a first pump aperture 81 capable of receiving a Schrader tire valve stem and a second pump aperture 82 capable of receiving a Presta tire valve stem of a tire (not shown).

Figure 13:
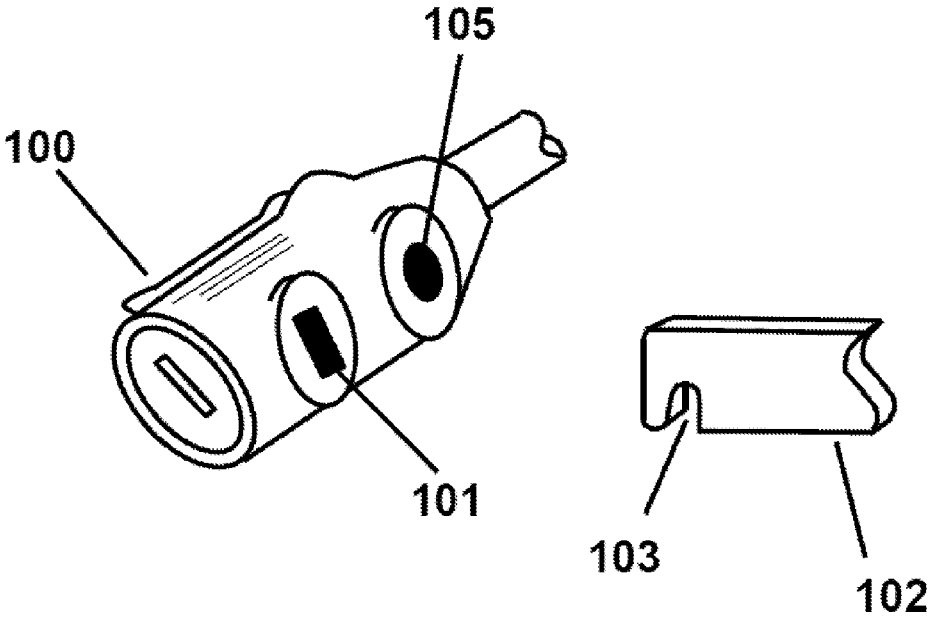
FIG. 13 is a perspective view of the male and female ends of a fifth embodiment of the present invention in an unlocked configuration.

As shown in FIG. 13, the fifth embodiment of the present invention is similar in construction to the previous embodiments described above with the principal difference being the first end 100 has a rectangular-shaped lock aperture 101 capable of receiving a rectangular shaped shackle 102 with a slot 103 for locking the shackle 102 within aperture 101. The first end 100 also includes a pump aperture 105 capable of receiving a tire valve stem of a tire (not shown).

Figure 14:
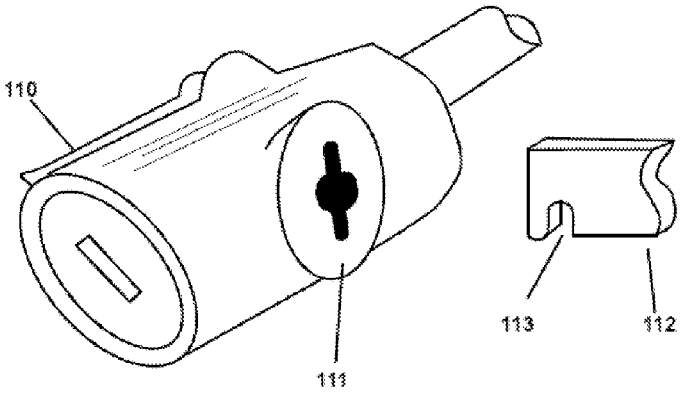
FIG. 14 is a perspective view of the male and female end of a sixth embodiment of the present invention in an unlocked configuration.

As shown in FIG. 14, the sixth embodiment of the present invention is similar in construction to the previous embodiments described above with the principal difference being the first end 110 has a dual-use aperture 111 to receive both a rectangular-shaped shackle 112 in a locked, position and the tire valve stem 50 in an inflation position. The shackle 112 includes a slot 113 for locking the shackle 112 within aperture 111.

Figure 15:
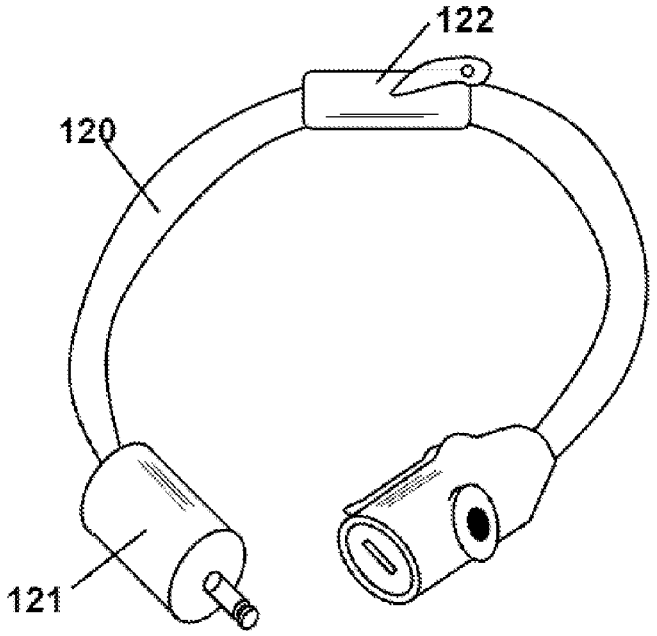
FIG. 15 is a perspective view of a seventh embodiment of the present invention in an unlocked configuration.

As shown in FIG. 15, the seventh embodiment of the present invention is similar in construction to the previous embodiments described above with the principal difference being the flexible cable 120, and not the second end 121, includes a piston-cylinder pump 122 of the combination lock and pump.

Figure 16:
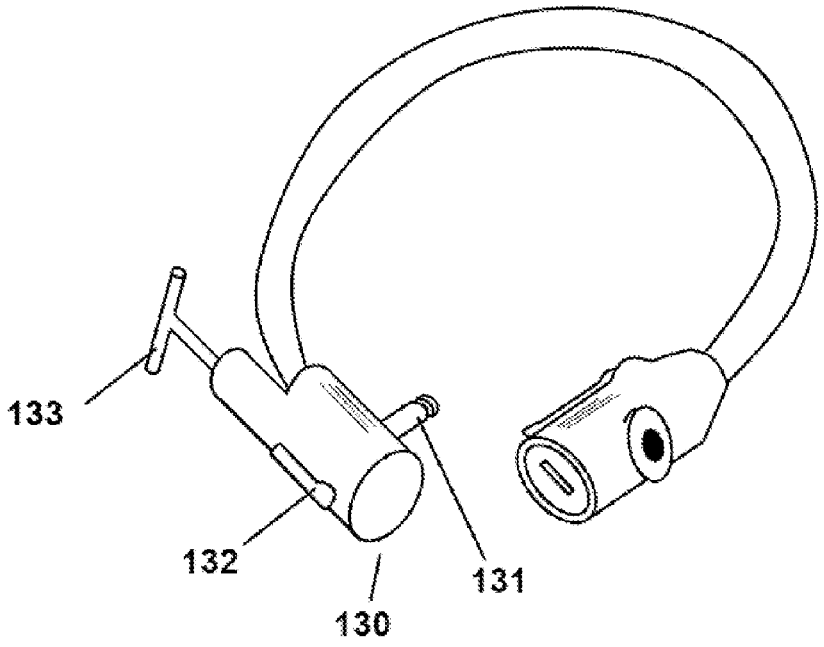
FIG. 16 is a perspective view of an eighth embodiment of the present invention in an unlocked configuration.

As shown in FIG. 16, the eighth embodiment of the present invention is similar in construction, to the previous embodiments described above with the principal difference being the second end 130 includes a locking bolt 131 projecting perpendicular to the body of the second end 130, a rotating projection 132 on a side of the second end 130 opposing the locking bolt 131, and an elongated pump piston-cylinder configuration 133 for use as a floor pump.

Each of the previous embodiments may also include an end of the flexible tube with a nozzle to receive a pressurized air cartridge for inflation of the bicycle tire.

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

The above description is intended to be illustrative and not restrictive. For example, the above-described examples (or one or more aspects thereof) may be used in combination with each other. Other embodiments can be used, such as by one of ordinary skill in the art upon reviewing the above description. The abstract is provided to comply with 37 C.F.R. 1.72(b) to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the following claims, along with the full scope of equivalents to which such claims are entitled.

While the present invention has been shown and described with reference to certain preferred embodiments, it is to be understood that those of ordinary skill in the art will no doubt devise certain alterations and modifications in form and detail to the present invention. The following claims are therefore intended to cover all such alterations and modifications that nevertheless incorporate the true spirit and scope of the invention.

What is claimed is:

1. A combination lock and inflation device having an unlocked position, a locked position, a non-inflation position, and an inflation position comprising:

a flexible cable having an inflation tube and at least one of a break-resistant rope or chain wherein the inflation tube has a first opening and a second opening;

a first end of the flexible cable having a lock portion capable of placing the combination in the locked position from the unlocked position and at least one aperture;

a second end of the flexible cable having a locking member and a housing wherein the locking member is receivable within the at least one aperture of the first end to securely maintain the combination in the locked position; and wherein the combination is operable to inflate a bicycle tire when a tire valve stem of the bicycle tire is in communication with the first opening of the inflation tube.

2. The combination lock and inflation device of claim 1 wherein the combination is operable to inflate the bicycle tire when the tire valve stem of the bicycle tire is inserted within the at least one aperture of the first end and in communication with the first opening of the inflation tube.

3. The combination lock and inflation device of claim 1 wherein the second opening of the inflation tube is located within the second end.

4. The combination lock and inflation device of claim 1 wherein the flexible cable further comprises a pump located between the first end and the second end of the flexible cable; wherein the pump further comprises a cylinder, a piston slidably communicating with the cylinder, and a piston rod connected at one end of the piston for actuating the piston; and wherein the second opening of the inflation tube is in communication with the cylinder.

5. The combination lock and inflation device of claim 1 wherein the second opening of the inflation tube is in communication with a pressurized air cartridge for inflation of the bicycle tire.

6. The combination lock and inflation device of claim 1 wherein the at least one aperture of the first end has a first aperture capable of receiving the locking member of the second end and a second aperture capable of receiving the tire valve stem of the bicycle tire.

7. The combination lock and pump of claim 1 wherein the lock portion of the first end further includes a lock lug portion that partially extends into the at least one aperture wherein the lock member of the second end is securably held by the lock lug when the combination is placed in the locked position.

8. The combination lock and pump of claim 1 wherein the first end further includes a lever arm, an urging member housed within the at least one aperture, a projecting member of the urging member, and an elastic body housed within the at least one aperture and including an axial bore extending therethrough wherein rotation of the lever arm to an upright position urges the urging member toward the elastic member such that the projection member is operable to deflect a valve pin of the tire valve stem and the elastic member is compressed to reduce an inner diameter of the axial bore to releasably engage the tire valve stem, which places the combination in the inflation position from the non-inflation position.

9. The combination lock and pump of claim 8 wherein the at least one aperture of the first end is capable of receiving the locking member of the second end and is capable of receiving the tire valve stem of the bicycle tire.

10. The combination lock and pump of claim 9 wherein the elastic member further includes a recess, and wherein the lock portion of the first end further includes a lock lug portion that partially extends into the at least one aperture and through the recess in the elastic member, wherein the lock member of the second end is securably held by the lock lug when the combination is placed in the locked position, and wherein the tire valve stem is releasably engaged by the elastic member when the combination is in the inflation position without being impeded by the lock lug when the combination is in the unlocked position.

11. The combination lock and pump of claim 1 wherein first end includes a barrel and wheel configuration having a hollow shaft body with an axial bore extending therethrough, a plurality of well holes in the shaft body, a plurality of locking balls positionable in the well holes, a plurality of clutches rotatable about the shaft body, a recess in each of the plurality of clutches to accept one of the plurality of locking balls when the combination is in the unlocked position, a plurality of combination wheels positionable on each of the plurality of clutches, and a plurality of circumferential grooves on the locking member wherein the plurality of locking balls are positionable in the plurality of circumferential grooves on the locking member when the plurality of locking balls are not within the recesses in the of the plurality of clutches to place the combination in the locked position.

12. The combination lock and pump of claim 11 wherein the plurality of clutches and the plurality of combination wheels are held in place by a cap on an end of the shaft body.

13. The combination lock and pump of claim 12 wherein the first end further includes an urging member, a projecting member projecting from a first side of the urging member, a spring portion of the inflation tube connected to a second side of the urging member, a retaining member with an axial bore extending therethrough, an elastic body with an axial bore extending therethrough, a collet, a lever arm, and wherein the shaft body includes a collar on an end opposite the cap.

14. The combination lock and pump of claim 13 wherein the spring portion of the inflation tube is housed within the cap of the shaft body when the combination is in the locked position.

15. The combination lock and pump of claim 13 wherein the collet of the first end further includes at least one arm and a plurality of fingers opposite the at least one arm wherein the lever arm is rotatably coupled to the at least one arm of the collet and the cap, and wherein rotation of the lever arm to an upright position pulls the at least one arm of the collet to urge the plurality of fingers of the collet into contact with an inner sidewall of the collar of the shaft body to deflect the plurality of fingers inwardly, and wherein the plurality of fingers of the collet compress the elastic body against the retaining member to reduce an inner diameter of the axial bore of the elastic body to releasably engage the tire valve stem and the urging member is retained in position by the at least one arm of the collet and spring portion of the inflation tube such that the projection member is operable to deflect a valve pin of the tire valve stem, which places the combination in the inflation position from the non-inflation position.

16. The combination lock and pump of claim 15 wherein the urging member is retained in position by the at least one arm of the collet such that the projection member is operable to deflect a valve pin of the tire valve stem due to a dimple in the at least one arm retaining a securing ball within another well hole in the shaft body upon rotation of the lever arm to the upright position.

17. The combination lock and pump of claim 1 wherein the piston-cylinder portion further includes a cap with rotatably connected handle members wherein the locking member of the second end is a portion of the piston rod, wherein the cap is slidably connected to the locking member, and wherein the cap and handle members are a handle for actuating the piston rod and piston to provide pressurized air to the bicycle tire via the inflation tube when in the inflation position.

18. The combination lock and pump of claim 1 wherein the second end has a piston-cylinder portion that is a floor pump.

19. The combination lock and pump of claim 1 wherein the at least one of a break-resistant rope or chain of the flexible cable is made of steel.

20. The combination lock and pump of claim 1 wherein the at least one of a break-resistant rope or chain of the flexible cable is made of plastic.

* * * * *